US011697869B2

(12) United States Patent
Specht et al.

(10) Patent No.: US 11,697,869 B2
(45) Date of Patent: Jul. 11, 2023

(54) METHOD FOR MANUFACTURING A BIOCOMPATIBLE WIRE

(71) Applicant: Heraeus Deutschland GmbH & Co. KG, Hanau (DE)

(72) Inventors: Heiko Specht, Hanau (DE); Sai Srikanth Golagani Venkata Kanaka, Singapore (SG); Zhen Yun Liu, Singapore (SG)

(73) Assignee: Heraeus Deutschland GmbH & Co. KG, Hanau (DE)

( * ) Notice: Subject to any disclaimer, the term of this patent is extended or adjusted under 35 U.S.C. 154(b) by 127 days.

(21) Appl. No.: 16/749,495

(22) Filed: Jan. 22, 2020

(65) Prior Publication Data

US 2021/0230728 A1 Jul. 29, 2021

(51) Int. Cl.

| | |
|---|---|
| ***C22F 1/10*** | (2006.01) |
| ***C21D 1/26*** | (2006.01) |
| ***C21D 8/06*** | (2006.01) |
| ***C22C 19/05*** | (2006.01) |
| ***C22C 19/07*** | (2006.01) |
| ***C22C 27/04*** | (2006.01) |

(Continued)

(52) U.S. Cl.

CPC ..... *C22F 1/10* (2013.01); *B21C 1/003* (2013.01); *B21F 45/008* (2013.01); *C21D 1/26* (2013.01); *C21D 8/06* (2013.01); *C21D 9/525* (2013.01); *C22C 19/05* (2013.01); *C22C 19/07* (2013.01); *C22C 27/04* (2013.01)

(58) Field of Classification Search

CPC .. C21D 8/06; C21D 9/52; C21D 9/525; B21C 1/003; B21F 45/008

See application file for complete search history.

(56) References Cited

U.S. PATENT DOCUMENTS

| | | | |
|---|---|---|---|
| 2,525,130 | A | 10/1950 | Hall et al. |
| 2,743,175 | A | 4/1956 | Talbot |

(Continued)

FOREIGN PATENT DOCUMENTS

| | | |
|---|---|---|
| EP | 1664360 | 3/2005 |
| JP | 2004-066316 | 3/2004 |

(Continued)

OTHER PUBLICATIONS

"Wire, Rod, and Tube Drawing" ASM Handbook, vol. 14A: Metalworking: Bulk Forming S.L. Semiatin, editor, p. 448-458 DOI: 10.31399/asm.hb.v14a.a0004008 (Year: 2005).*

(Continued)

*Primary Examiner* — Anthony J Zimmer
*Assistant Examiner* — Sean P. O'Keefe
(74) *Attorney, Agent, or Firm* — Dicke, Billig & Czaja, PLLC

(57) ABSTRACT

The disclosure relates to a method for manufacturing a biocompatible wire, a biocompatible wire comprising a biocompatible metallic material and a medical device comprising such wire. The method for manufacturing a biocompatible wire comprises providing a workpiece of a biocompatible metallic material, cold working the workpiece into a wire, and annealing the wire, wherein a cold work percentage is 97 to 99%, wherein the cold working is a drawing with a die reduction per pass ratio in a range of 6 to 40%, and wherein the annealing is done in a range of 850 to 1100° C.

6 Claims, 6 Drawing Sheets

(51) Int. Cl.

| | |
|---|---|
| ***B21F 45/00*** | (2006.01) |
| ***B21C 1/00*** | (2006.01) |
| ***C21D 9/52*** | (2006.01) |

(56) References Cited

U.S. PATENT DOCUMENTS

| | | | |
|---|---|---|---|
| 3,356,542 | A | 12/1967 | Smith |
| 3,711,385 | A | 1/1973 | Beer |
| 4,048,045 | A | 9/1977 | Eng et al. |
| 4,487,744 | A | 12/1984 | DeBold et al. |
| 4,652,315 | A | 3/1987 | Igarashi et al. |
| 4,655,900 | A | 4/1987 | Neti et al. |
| 4,822,459 | A | 4/1989 | Ueda et al. |
| 5,019,184 | A | 5/1991 | Crum |
| 5,077,006 | A | 12/1991 | Culling |
| 5,096,667 | A | 3/1992 | Fetcenko |
| 5,104,607 | A | 4/1992 | Driska |
| 5,130,085 | A | 7/1992 | Tendo et al. |
| 5,238,756 | A | 8/1993 | Fetcenko et al. |
| 5,283,032 | A | 2/1994 | Wanner et al. |
| 5,290,415 | A | 3/1994 | Shimamune et al. |
| 5,318,572 | A | 6/1994 | Helland et al. |
| 5,403,547 | A | 4/1995 | Smith et al. |
| 5,405,522 | A | 4/1995 | Braden et al. |
| 5,439,640 | A | 8/1995 | Heck et al. |
| 5,476,555 | A | 12/1995 | Erickson |
| 5,478,417 | A | 12/1995 | Heck et al. |
| 5,630,840 | A | 5/1997 | Mayer |
| 5,939,204 | A | 8/1999 | Czech |
| 5,945,067 | A | 8/1999 | Hibner et al. |
| 6,623,869 | B1 | 9/2003 | Nishiyama et al. |
| 6,761,777 | B1 | 7/2004 | Radon |
| 7,015,392 | B1 | 3/2006 | Dickenson |
| 7,280,875 | B1 | 10/2007 | Chitre et al. |
| 7,305,270 | B1 | 12/2007 | Kroll et al. |
| 7,396,597 | B2 | 7/2008 | Nishiyama et al. |
| 7,715,721 | B2 | 5/2010 | Solheim et al. |
| 7,758,805 | B2 | 7/2010 | Kohno et al. |
| 7,780,798 | B2 | 8/2010 | Stinson |
| 8,048,369 | B2 | 11/2011 | Forbes Jones et al. |
| 8,313,591 | B2 | 11/2012 | Hirata et al. |
| 8,479,700 | B2 | 7/2013 | Qiao et al. |
| 8,808,473 | B2 | 8/2014 | Hirata et al. |
| 9,138,963 | B2 | 9/2015 | Cetel et al. |
| 9,228,250 | B2 | 1/2016 | Alves et al. |
| 9,243,304 | B2 | 1/2016 | Pieper et al. |
| 9,260,770 | B2 | 2/2016 | Jönsson et al. |
| 9,650,698 | B2 | 5/2017 | Hattendorf |
| 9,765,416 | B2 | 9/2017 | Banik |
| 9,856,544 | B2 | 1/2018 | Young et al. |
| 9,932,655 | B2 | 4/2018 | Hamaguchi et al. |
| 10,109,855 | B2 | 10/2018 | Young et al. |
| 2005/0051243 | A1 | 3/2005 | Forbes Jones et al. |
| 2006/0029640 | A1 | 2/2006 | Gilbert et al. |
| 2010/0075168 | A1* | 3/2010 | Schaffer ..... A61L 31/022 148/559 |
| 2011/0011500 | A1 | 1/2011 | Mannan |
| 2011/0276124 | A1 | 11/2011 | Doerr et al. |
| 2012/0271381 | A1* | 10/2012 | McIntyre ..... C22C 14/00 607/62 |
| 2012/0271386 | A1* | 10/2012 | Li ..... A61N 1/05 607/116 |
| 2012/0273090 | A1 | 11/2012 | Shi et al. |
| 2013/0008687 | A1 | 1/2013 | Lu et al. |
| 2013/0338756 | A1 | 12/2013 | Gerold |
| 2014/0228967 | A1 | 8/2014 | Wittchow |
| 2014/0228968 | A1 | 8/2014 | Wittchow |
| 2014/0277420 | A1 | 9/2014 | Migliazza et al. |
| 2014/0378949 | A1 | 12/2014 | Schaffer |
| 2015/0080998 | A1 | 3/2015 | Mueller et al. |
| 2015/0099958 | A1 | 4/2015 | Shan |
| 2015/0101613 | A1 | 4/2015 | Tal et al. |
| 2015/0119995 | A1 | 4/2015 | Mueller et al. |
| 2015/0129091 | A1 | 5/2015 | Mueller et al. |
| 2015/0129092 | A1 | 5/2015 | Mueller et al. |
| 2015/0136591 | A1 | 5/2015 | Fraim et al. |
| 2015/0235729 | A1 | 8/2015 | Yoshida et al. |
| 2016/0051384 | A1 | 2/2016 | Patel et al. |
| 2016/0111178 | A1 | 4/2016 | McIntyre et al. |
| 2016/0151610 | A1* | 6/2016 | Schaffer ..... C22F 1/006 29/428 |
| 2016/0256598 | A1 | 9/2016 | Zucker et al. |
| 2016/0346437 | A1 | 12/2016 | Zucker et al. |
| 2017/0175235 | A1* | 6/2017 | Richter ..... A61N 1/056 |
| 2017/0216494 | A1 | 8/2017 | Roth et al. |
| 2018/0192939 | A1 | 7/2018 | Roth et al. |
| 2018/0303643 | A1 | 10/2018 | Mitchell et al. |
| 2018/0304042 | A1 | 10/2018 | Donegan |
| 2018/0363115 | A1* | 12/2018 | Richter ..... C22C 19/055 |
| 2018/0363146 | A1* | 12/2018 | Richter ..... H01B 13/0036 |
| 2018/0366238 | A1* | 12/2018 | Richter ..... C22C 19/056 |
| 2018/0366239 | A1* | 12/2018 | Richter ..... A61N 1/05 |
| 2019/0292640 | A1 | 9/2019 | Cai et al. |

FOREIGN PATENT DOCUMENTS

| | | |
|---|---|---|
| JP | 2008-093673 | 4/2008 |
| JP | 2008-184643 | 8/2008 |
| JP | 2017-158608 | 9/2017 |
| WO | 2004006377 | 1/2004 |
| WO | 2005026399 | 3/2005 |
| WO | 2016064790 | 4/2016 |

OTHER PUBLICATIONS

ASTM International, "Standard Specification for Wrought 35Cobalt-35Nickel-20Chromium-10Molybdenum Alloy for Surgical Implant Applications (UNS R30035)," Designation: F562-13, pp. 5 (Mar. 1, 2013).

* cited by examiner

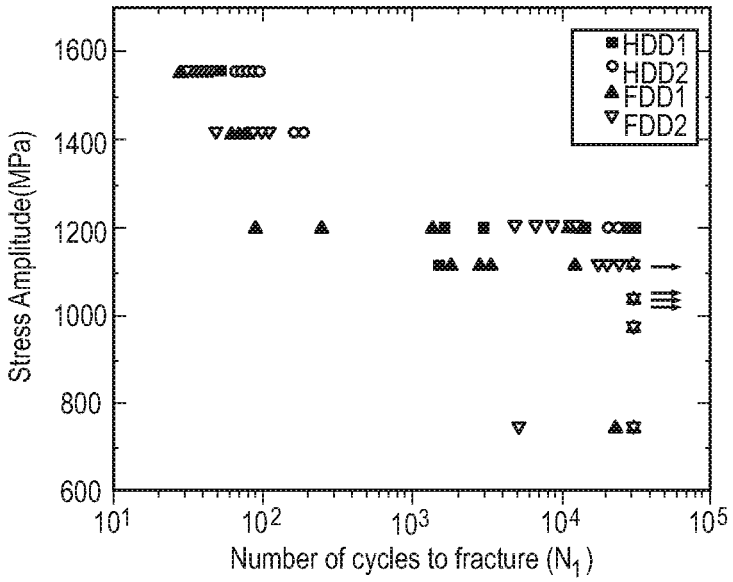
Fig. 3c
Fig. 4a
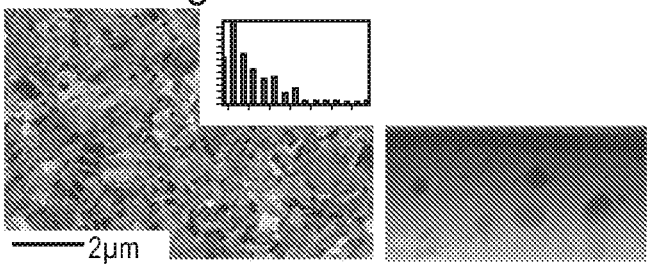
16% CW
Fig. 4b
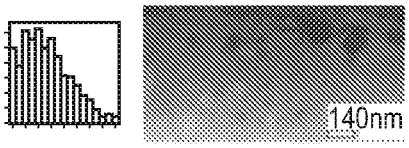
50% CW
Fig. 4c
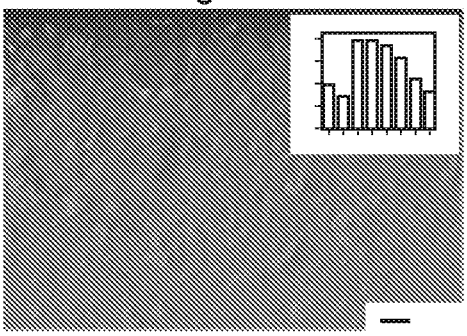
75% CW
Fig. 4d
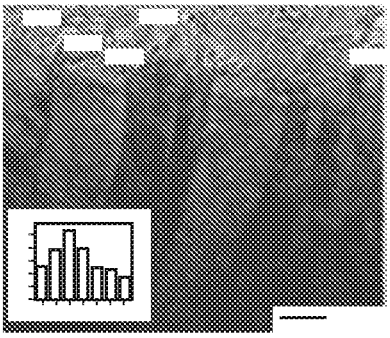
95% CW

16% CW 50% CW

75% CW

95% CW

50% CW

75% CW

95% CW

50% CW

75% CW

95% CW

50% CW

75% CW

95% CW

Fig. 9a
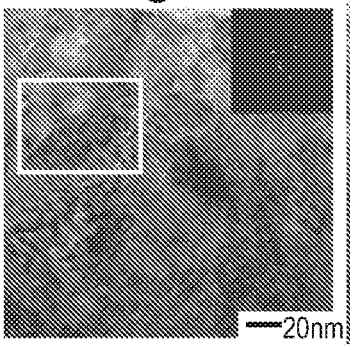
50% CW
Fig. 9b
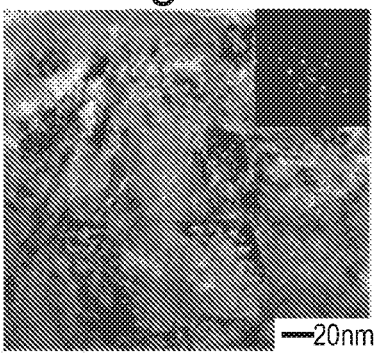
75% CW
Fig. 9c
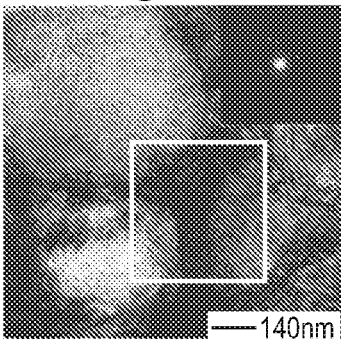
95% CW
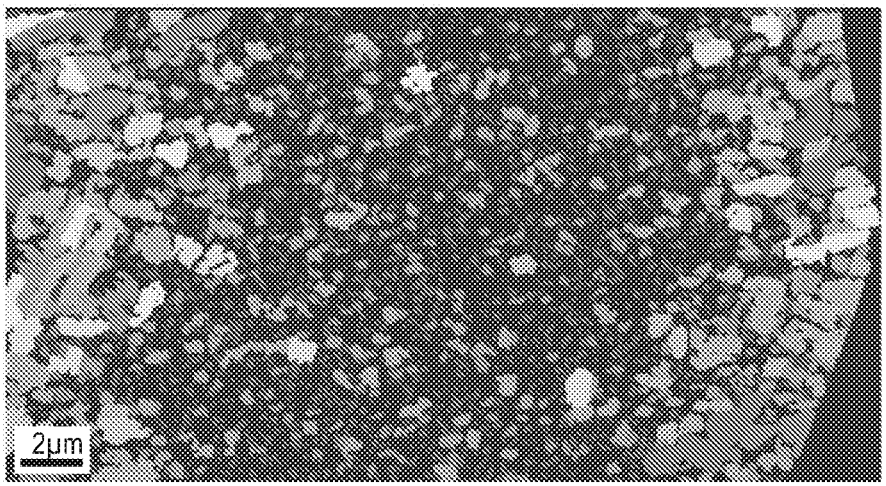
Grain Size (diameter)
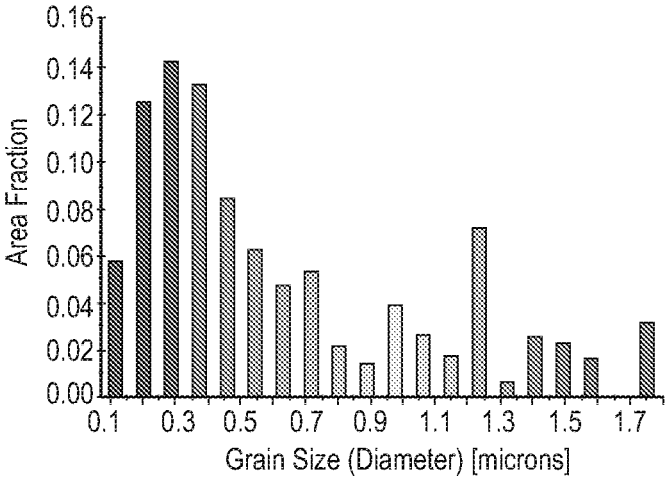
Fig. 10

METHOD FOR MANUFACTURING A BIOCOMPATIBLE WIRE

BACKGROUND

The disclosure relates to a method for manufacturing a biocompatible wire, a biocompatible wire comprising a biocompatible metallic material and a medical device comprising such wire.

There are many conventional methods for manufacturing a biocompatible wire, which can be still improved.

SUMMARY

Hence, there may be a need to provide an improved method for manufacturing a biocompatible wire, which in particular allows to achieve a wire with improved fatigue life.

The problem of the present disclosure is solved by the subject-matters of the independent claims, wherein further embodiments are incorporated in the dependent claims. It should be noted that the aspects of the disclosure described in the following apply also to the method for manufacturing a biocompatible wire, the biocompatible wire comprising a biocompatible metallic material and the medical device comprising such wire.

According to the present disclosure, a method for manufacturing a biocompatible wire is presented. The method for manufacturing a biocompatible wire includes the steps of providing a workpiece of a biocompatible metallic material, cold working the workpiece into a wire, and annealing the wire. A cold work percentage is 97 to 99%. The cold working is a drawing with a die reduction per pass ratio in a range of 6 to 40%. The annealing is done in a range of 850 to 1100° C.

The present manufacturing method for a biocompatible wire can be considered as an optimized thermo-mechanical process including drawing and annealing steps to produce an improved biocompatible wire. The wires manufactured by the present manufacturing method can have an improved fatigue life through smaller grain sizes and a specific grain size distribution of the wire material and/or a controlled number of dislocations and twins in the crystal structure of the wire. The wires manufactured by the present manufacturing method can have a higher ductility and a higher ultimate strength.

The wires manufactured by the present manufacturing method can be used for medical applications and in particular to produce coils, strands and the like for medical applications. The medical applications can be Cardiac Rhythmic Management (CRM), neurostimulation, neuromodulation, Deep Brain Stimulation (DBS) and the like.

The biocompatible wire can be made of or include biocompatible metallic materials and alloys, as for example MP35N® and MP35NLT™ alloy (35% Co-20% Cr-35% Ni-10% Mo with low titanium). The term "biocompatible" can be understood as a quality of not having toxic or injurious effects on biological systems, an ability of a material to perform with an appropriate host response in a specific application, a comparison of a tissue response produced through a close association of an implanted candidate material to its implant site within a host animal to that tissue response recognized and established as suitable with control materials, refers to the ability of a biomaterial to perform its desired function with respect to a medical therapy, without eliciting any undesirable local or systemic effects in the recipient or beneficiary of that therapy, but generating the most appropriate beneficial cellular or tissue response in that specific situation, and optimizing the clinically relevant performance of that therapy and/or as a capability of a prosthesis implanted in the body to exist in harmony with tissue without causing deleterious changes.

In an embodiment, the biocompatible metallic material is an alloy comprising the following components: Cr in the range from about 10 to about 30 wt. %; Ni in the range from about 20 to about 50 wt. %; Mo in the range from about 2 to about 20 wt. %; Co in the range from about 10 to about 50 wt. % and optionally less than 0.01 wt. % Ti. In an embodiment, the Cr, Ni, Mo and Co components are major constituents of the alloy with at least about 95 wt. % of the alloy being Cr, Ni, Mo and Co.

After the first cold working and the first annealing (described above), at least a second cold working and/or a second annealing can follow. There can also be at least an initial cold working and/or an initial annealing before above described first cold working and the first annealing.

The cold work applied to the material decides the geometrical and the mechanical attributes of the wire, as for example its strength. A last and final cold working step defines a final strength of the wire.

The annealing allows the wire to soften, which might be particular useful to further process the wire to a smaller diameter if needed. The annealing involves parameters of temperature and time, which can depend upon prior deformation and type of material. In case the wire is made of MP35N® and MP35NLT™ alloy, the annealing can be done in the range of 1000° C. to 1100° C. In case the wire is made of an MP35N® and MP35NLT™ alloy cladded with Ag, the annealing can be done below the melting point of silver, which is around 960° C. When reducing a diameter of the wire (e.g. by drawing), a duration of the annealing step can be reduced from, e.g., minutes to seconds. Further, the process can be changed from batch annealing to strand annealing. For strand annealing, the amount of time the wire spends in a furnace for annealing can be in the order of few tenths of a second.

In an embodiment, the drawing is a full die drawing. The drawing may also be a half die drawing. In an embodiment, the drawing is done with a deformation factor in a range of 1.2 to 2.0 and a contact length between the workpiece and a drawing tool in a range of 0.5 to 0.2 mm. In an embodiment, the drawing is done with a speed in a range of 15 to 150 m/min. In an embodiment, the initial diameter before drawing is in a range of 3 to 5 mm and/or a diameter of the wire after drawing is in a range of 0.1 to 0.9 mm. In an embodiment, the annealing is done for 750 to 1500 seconds. In an embodiment, the method for manufacturing a biocompatible wire further includes an additional drawing after the annealing with a cold working percentage of 95 to 97%.

The present disclosure deals with the influence of drawing practices namely Full Die Drawing (FDD) and Half Die Drawing (HDD) on the mechanical and electrical properties, deformation homogeneity, plastic instability, strain rate sensitivity, strain rate hardening and cyclic fatigue behavior of MP35N® and MP35NLT™ wires, drawn to different cold work (CW) reductions. The properties are associated and compared against its microstructure, which has been characterized by FESEM, SEM, EBSD, and TEM.

The FDD drawing proves involved receding the cross-sectional area of the wire at a reduction per pass ratio of 20-30%, with the die semi-angle ($\alpha$) of 6-8° and by controlling the $\Delta$ (deformation factor) value in the range of 1.2-2.0 and with the L value (i.e. the contact length between the work piece and the die) in the range of 0.5-0.2 mm, when compared with the HDD wire drawing processes which generally involve drawing with a Δ value in the range of 2.5-5.0 and with the L being in the range of 0.15-0.05 mm and at an reduction per pass ratio of 6-10%. The wire is drawn from an initial diameter of 3.7 mm to 0.6 mm with a CW of 97-99%, using a single die drawing machine and Poly Crystalline Diamond (PCD) dies. For the MP35N® and MP35NLT™ wires, there was only one intermediate annealing applied after 97-99% CW at a temperature of 1050° C.-1100° C. using a spool to spool annealing machine for a duration of 900-1000 seconds. The wire was further drawn to a diameter of 0.141 mm with a CW of 95-97% using a slip type multiple drawing machine using natural diamond (ND) dies and with varying drawing methods. The wires were drawn at a speed of 30m/min to 100m/min depending upon the diameter of the wire drawn, i.e., slower speeds for drawing big diameter wires and faster speeds for drawing smaller diameters, and the wires are drawn using an oil-based lubricant. The FDD method was completed in a shorter time with the total number of dies used being less than 10, while the HDD technique utilized 32-60 dies to complete the total cold work reduction of 98%.

According to the present disclosure, also a biocompatible wire comprising a biocompatible metallic material is presented. The biocompatible wire includes a biocompatible metallic material which is cold worked from a workpiece and annealed. A cold work percentage is 97 to 99%. The cold working is a drawing with a die reduction per pass ratio in a range of 6 to 40%. The annealing is done in a range of 850 to 1100° C.

In an embodiment, the biocompatible metallic material is an alloy comprising the following components:

Cr in the range from about 10 to about 30 wt. %;
Ni in the range from about 20 to about 50 wt. %;
Mo in the range from about 2 to about 20 wt. %;
Co in the range from about 10 to about 50 wt. %.

In an embodiment, the Cr, Ni, Mo and Co components are major constituents of the alloy with at least about 95 wt. % of the alloy being Cr, Ni, Mo and Co. In an embodiment, the biocompatible metallic material further includes an additional component comprising at least one of a group of Silver, Platinum, Tantalum, Gold, Copper and alloys thereof.

In an embodiment, the Cr, Ni, Mo and Co alloy forms a core and the additional material forms a shell around the core when the wire is seen in a cross section. In another embodiment, the additional material forms a core and the Cr, Ni, Mo and Co alloy forms a shell around the core when the wire is seen in a cross section.

In an embodiment, the wire includes grains with a mean grain size in a range of 20 to 1000 nm.

In an embodiment, the wire has a yield strength in a range of 1300 to 1900 MPa.

In an embodiment, the wire has an ultimate tensile strength in a range of 1700 to 2400 MPa.

In an embodiment, the wire has an essentially uniform grain size distribution along a cross section of the wire.

According to the present disclosure, also a medical device is presented. The medical device includes a wire as described above as a lead. The medical device can be used for Cardiac Rhythmic Management (CRM), neurostimulation, neuromodulation, Deep Brain Stimulation (DBS) and the like.

It shall be understood that the wire, the device, and the manufacturing method according to the independent claims have similar and/or identical preferred embodiments, in particular, as defined in the dependent claims. It shall be understood further that a preferred embodiment of the disclosure can also be any combination of the dependent claims with the respective independent claim.

These and other aspects of the present disclosure will become apparent from and be elucidated with reference to the embodiments described hereinafter.

BRIEF DESCRIPTION OF THE DRAWINGS

Exemplary embodiments of the disclosure will be described in the following with reference to the accompanying drawing:

FIG. 3*c*: illustrates schematically and exemplarily an S-N curve comparison between FDD and HDD wires drawn to 95% CW.

FIGS. 4*a-d*: illustrate schematically and exemplarily grain size distributions of the MP35NLT™ wire drawn with the FDD drawing process for different CW reductions.

FIGS. 8*a-e*. illustrate schematically and exemplarily a twin density of the MP35NLT™ wire drawn with the FDD drawing process for different CW reductions.

FIGS. 9*a-c*: illustrate schematically and exemplarily a twin density of the MP35NLT™ wire drawn with the HDD drawing process for different CW reductions.

FIG. 10: illustrate schematically and exemplarily a wire drawn with the new drawing process and subjected to stress relief temperature of 875° C. for a dwell time of 3.1 seconds.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Figure 1:
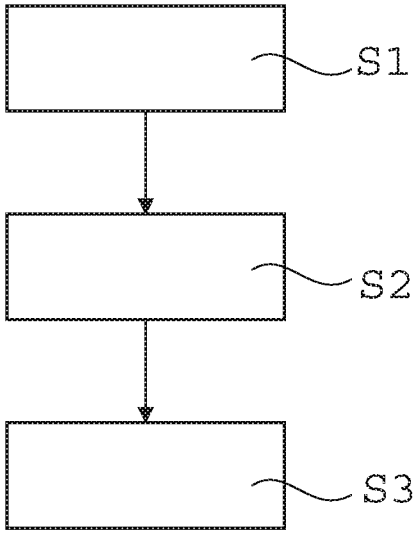
FIG. 1 illustrates schematically and exemplarily an embodiment of a method for manufacturing a biocompatible wire.

FIG. 1 illustrates schematically and exemplarily an embodiment of a method for manufacturing a biocompatible wire. The method for manufacturing a biocompatible wire includes the steps of:

S1. providing a workpiece of a biocompatible metallic material,

S2. cold working the workpiece into a wire, and

S3. annealing the wire.

A cold work percentage is 97 to 99%, the cold working is a drawing with a die reduction per pass ratio in a range of 6 to 40%, and the annealing is done in a range of 850 to 1100° C.

The drawing is a full die drawing. The drawing is done with a deformation factor in a range of 1.2 to 2.0 and a contact length between the workpiece and a drawing tool in a range of 0.5 to 0.2 mm. The drawing is done with a speed in a range of 15 to 150 m/min. An initial diameter before drawing is in a range of 3 to 5 mm and/or a diameter of the wire after drawing is in a range of 0.1 to 0.9 mm. The annealing is done for 750 to 1500 seconds. The method for manufacturing a biocompatible wire may further include an additional drawing after the annealing with a cold working percentage of 95 to 97%.

The biocompatible wire can be made of or include biocompatible metallic materials and alloys, as for example MP35N® and MP35NLT™ alloy (35% Co-20% Cr-35% Ni-10% Mo with low titanium).

Figure 2:
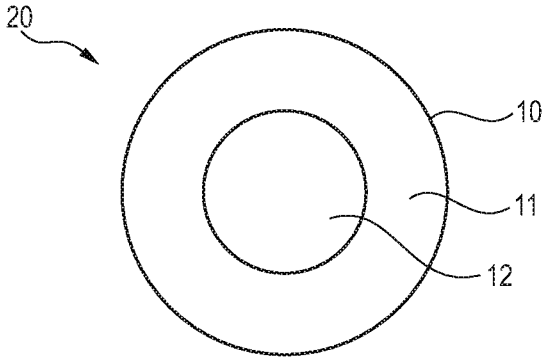
FIG. 2 illustrates schematically and exemplarily an embodiment of a biocompatible wire comprising a biocompatible metallic material.

FIG. 2 illustrates schematically and exemplarily an embodiment of a biocompatible wire 10 comprising a biocompatible metallic material, which is cold worked from a workpiece and annealed, wherein a cold work percentage is 97 to 99%. The cold working is a drawing with a die reduction per pass ratio in a range of 6 to 40% and the annealing is done in a range of 850 to 1100° C. FIG. 2 further illustrates a medical device 20 comprising such biocompatible wire 10 as a lead.

The biocompatible metallic material is an alloy comprising the following components: Cr in the range from about 10 to about 30 wt. %; Ni in the range from about 20 to about 50 wt. %; Mo in the range from about 2 to about 20 wt. %; Co in the range from about 10 to about 50 wt. %. The Cr, Ni, Mo and Co components are major constituents of the alloy with at least about 95 wt. % of the alloy being Cr, Ni, Mo and Co. The biocompatible metallic material further includes an additional material comprising at least one of a group of Silver, Platinum, Tantalum, Gold, Copper and alloys thereof.

The wire 10 includes grains with a mean grain size in a range of 20 to 1000 nm. The wire 10 has a yield strength in a range of 1300 to 1900 MPa. The wire 10 has an ultimate tensile strength in a range of 1700 to 2400 MPa. The wire 10 has an essentially uniform grain size distribution along a cross section of the wire.

The Cr, Ni, Mo and Co alloy may form a core 12 and the additional material may form a shell 11 around the core 12 when the wire is seen in a cross section. Otherwise, the additional material may form a core 12 and the Cr, Ni, Mo and Co alloy may form a shell 11 around the core 12 when the wire 10 is seen in a cross section.

Test Conditions

The amount of strain applied in the wire drawing process is defined by the relation;

$$\varepsilon = 2\ln\frac{d_i}{d_f};$$

where $d_i$ is the initial diameter and $d_f$ is the final diameter, and the SR is defined as the variation of strain over time. In the actual drawing process, the SR applied on the material is differed by changing the drawing speed, which changes the applied strain over time. The amount of CW applied to the material is calculated as $$CW = 1 - \left[\frac{D_n}{D_1}\right]^2$$

where D1 diameter of the first die and $D_n$ is the nth die used.

The as-drawn wires were deformed in uniaxial tension as per ASTM standard E8, using an Instron 6400 test frame, with a load cell of 500 N and by pneumatic yarn grips. The cross-head speed was set at 12.7 mm/min, and the gauge length was maintained at 254 mm for all the samples tested. The testing was performed at room temperature, and the samples were tested until fracture. The hardness test was performed as per ASTM standard A384-17, and the load was differed from 100 to 150 g based on the diameter of the indented wire. The indentation was performed both in the longitudinal and transverse sections of the wire, and the indentation time was around 15-20 seconds for each sample. Five points are intended along both the axis which is equidistant from each other and evenly dispersed along their length. Hardness values were recorded in Vickers Hardness Scale ($H_v$).

The electrical resistivity of the wires was measured using Burster 2316 resistomat. The device accords to the proven 4-wire sensing method or by 4-point probe method which is an electrical impedance measuring technique that uses separate pairs of current-carrying and voltage-sensing electrodes to make more accurate measurements than traditional two-terminal sensing. For each CW % condition, wire samples of 1m long were cut and clamped between the two connecting ends of the clamping device. The wires have been tested at room temperature with the temperature compensation set to 20° C. and the resistivity data recorded in units of ohm/m. The obtained values are then converted into the conductivity measurements and plotted in SI derived units of Siemens/meter.

The wire specimens drawn with different drawing practices are subjected to cyclic fatigue tests on a rotary beam fatigue tester (RBFT) as per ASTM standard E2948-16a. The tests were conducted on a custom-built fatigue test machine by Heraeus. Before the fatigue loading, the drawn wires were straightened by a roller straightening machine, to remove the residual curvature known as "cast," in the wire which is a geometrical attribute inherited from the cold wire drawing process. This step needs to be done to minimize the variation in the test data, and it was observed during the fatigue set-up that the wires without straightening would spin out of the chuck and fracture at the chucks leading to erroneous results. The straightened wires were cut to the desired length based on the input variables of the chuck distance, wire diameter, young's modulus (E), applied stress and the length of the wire was determined from the respective calculations stated in the standard E2948-16a. One end of the wire is clenched to a hollow bush, and the other end of the wire is clamped to a rotating chuck which rotates at a speed of 3000 RPM and operates at a frequency of 50 Hz. The vibration supports are mounted along the curvature of the wire, and the break detection probes are placed along the wire. A cyclic counter fixed to the machine records the number of cycles to failure, and for each revolution of the chuck, the wire specimens are subjected to an alternate compression and tension cycles during its course of cyclic loading. The tests were performed at room temperature using air as a medium.

Full Die Drawing (FDD) and Half Die Drawing (HDD)

MP35NLT™ wires drawn with different drawing practices namely the FDD and HDD; by varying the amount of deformation per pass induced on the wire, contributed to a wire with different mechanical and work hardening characteristics in the material. The plastic instability and the strain rate sensitivity of the materials also varied significantly with the change of deformation process. The wires drawn with the FDD drawing process contributed to a higher strength and ductility in the material when compared to the HDD drawn wires for a similar CW reduction. A softening effect in the material was observed in the wires drawn with FDD practice between 75-90% CW, which led to a reduction of material strength and increased ductility after which it increased again. This phenomenon was attributed to the "Inverse Hall Petch Effect. The deformation homogeneity was higher for the FDD drawn wires, due to the lowered inhomogeneity factor, because of the uniformity in the grain size and the microstructure gradient across the wire. The plastic instability (PI), which determines the load bearing capacity or the resistant to necking was lower in the FDD wire until 75% CW, after which it increased upon increase of reduction to 95%. The increase in PI was ascribed to the formation of shear bands in the FDD drawn wire, which led to increased plastic strain localization in the material, due to the exhaustion of the dislocation density with the reduced grain size. The lower PI until 75% CW was attributed to the higher twin density, and lower twin spacing seen in the FDD wire, which accorded to a higher strain rate work hardening (SRWH) and strain rate sensitivity (SRS) in the wire, which delayed the onset of necking and enhanced ductility in the wire. The Strain Rate Sensitivity (SRS) or m value, of the FDD drawn wire decreased with the increase of SR, due to the reduction in the dislocation-based activities and increased GB shearing and diffusion in the deformed wire. The twin spacing increased with the increase of SR for the FDD drawn wire, thus contributing to a lower m. However, with the HDD drawn wire, at an SR of $10^{-6}$ $s^{-1}$, the value of m, was 65% lower than the FDD value. The reason for such a low SRS value has been attributed to the increased localized strain concentration in the material, leading to the formation of shear bands in the material which reduces the capability of the material to resist necking and thus reducing the ductility of the material. An abnormal hardening effect was observed in the HDD drawn subjected to an SR of $10^{-2}$ $s^{-1}$, the stage II hardening peak originated at a high strain, instead of its normal commencement at low SR, after the dynamic recovery. This effect was due to the solute segregation of the Mo atoms to the GB, as observed by the increased concentration of the Mo in the deformed structure, which increased the strength and the hardening capacity of the wire.

The Low Cycle Fatigue (LCF) and High Cycle Fatigue (HCF) performance of the FDD drawn wire was remarkably higher than the HDD drawn wire until 75% CW. The enhanced LCF performance for the FDD drawn wire, is attributed to the higher ductility in the wire, because of the higher number of coherent twin boundaries (CTB) noticed in the FDD drawn wire; this allowed the dislocation to penetrate and slip through them, thus increasing the endurance limit of the wire. The FDD drawn wire also had a smaller grain size when compared to the HDD wire, which contributed to increased strength and higher dislocation density in the wire, thus bestowing to an improved HCF performance. The post fatigued microstructure of the FDD wire also exhibited a dislocation cell and vein structure with several nanotwins embedded between the grain boundaries (GB) and the dislocation pile-up. There was a substantial decrease in the LCF and HCF performance of the FDD wires, upon increase of CW to 95%, there were shear bands observed in the microstructure of the FDD drawn wire, which increased the strain localization and a reduced fatigue endurance. There were no striations observed in the FDD drawn wire in both the LCF and HCF wires, this is because of the reduced ductility in the wire, due to the formation of shear bands. The fractured samples exhibited a brittle cleavage fracture, whereas the HDD wire displayed a dimple striation fracture with a dislocation cell structure with nanotwins embedded at the interface of the GB.

Based on the above observations it can be concluded that the reduction of the grain size to a nanometer scale can be obtained at a lower CW reduction and a higher annealing temperature unlike the prior art. Higher mechanical properties can be obtained in the wire through an optimum control of microstructure and their characteristics such as dislocation density and twin density. The plastic instability studies have given valuable information on the materials response to deformation and their limitations to the applied strain during the drawing process. The strain rate simulation studies which were the first of its kind to be done on this material till date, have led to crucial information in exhibiting the material response when subjected to different speeds during the wire drawing process.

Cyclic Performance

The influence of drawing practices namely Full Die Drawing (FDD) and Half Die Drawing (HDD) on the cyclic performance of MP35NLT™ wires have been investigated, by differing the amount of plastic strain applied on the material. The as-drawn wires were subjected to rotary beam fatigue tests (R=−1) with varying stress amplitudes, and the microstructural factors controlling the Low Cycle Fatigue (LCF) and High Cycle Fatigue (HCF) performance were determined through post fatigued TEM investigations. So, the purpose is to characterize the influence of the drawing practices on the cyclic response or fatigue behavior of the MP35NLT™ wires, drawn to varying cold work (CW) reductions and correlate a link between the process, microstructure, and fatigue.

Five specimens for each stress amplitude are tested between 500-1500 MPa with a stress ratio of R=−1. Six lots (three from FDD and three from HDD) are tested for the 50% CW condition, and four lots (two from FDD and two from HDD) are tested for the 75 and 95% CW conditions. The runout or the endurance limit for the condition is determined only if all the five samples reach the 30 million (30M) cycles. The post-fatigued specimens are collected and appropriately identified for further microstructure characterization by Transmission Electron Microscope (TEM).

The starting diameters of the material used for the fatigue characterization was 0.62 mm and 0.141 mm respectively, and the material was prepared in a fully annealed condition. Three different samples namely 50%, 75% and 95% CW are manufactured by varying the total area reduction. The 0.141 mm annealed wire was drawn to a diameter of 0.101 mm to obtain the 50% CW samples; however, for the 75% and 95% CW samples, the 0.62 mm wire was drawn to a diameter of 0.318 and 0.141 mm respectively. The detailed description of the drawing process for the wires drawn to different CW reductions is illustrated in Table.

TABLE 1

Experimental detail comparison of the FDD and HDD wire drawing process.

| Start Diameter (mm) | End Diameter (mm) | Number of Passes FDD | Number of Passes HDD | Area Reduction (%) per pass FDD | Area Reduction (%) per pass HDD | Cold Work (CW) (%) |
|---|---|---|---|---|---|---|
| 0.62 | 0.620 | 0 | 0 | 0 | 0 | 0 |
| 0.141 | 0.1011 | 1 | 1 | Pass 1: 48.6 | Pass 1: 50.1 | 50 |
| 0.62 | 0.3171 | 1 | 2 | Pass 1: 73.6 | Pass 1: 46.7<br>Pass 2: 48.7 | 75 |
| 0.62 | 0.1413 | 3 | 5 | Pass 1: 66.8<br>Pass 2: 68.7<br>Pass 3: 49.7 | Pass 1: 46.7<br>Pass 2: 48.7<br>Pass 3: 53.6<br>Pass 4: 36.7<br>Pass 5: 33.2 | 95 |

Figure 3A:
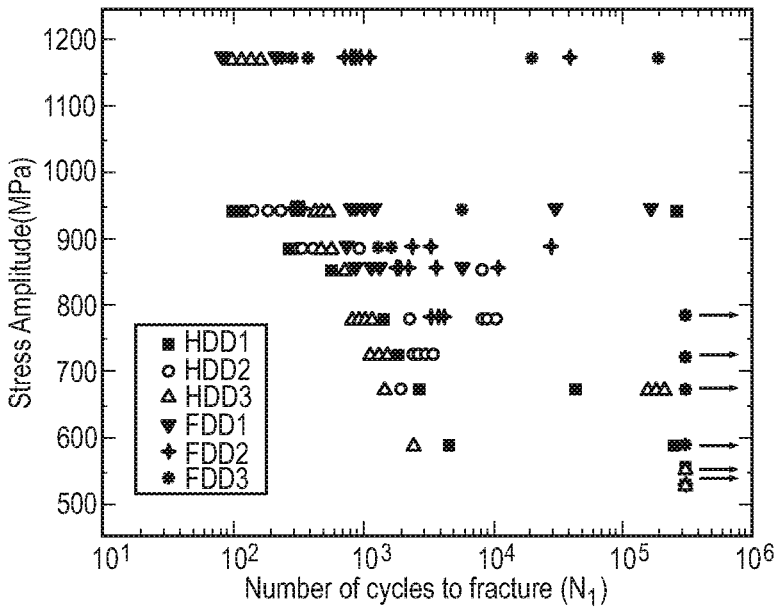
FIG. 3*a*: illustrates schematically and exemplarily an S-N curve comparison between FDD and HDD wires drawn to 50% CW.
Figure 3B:
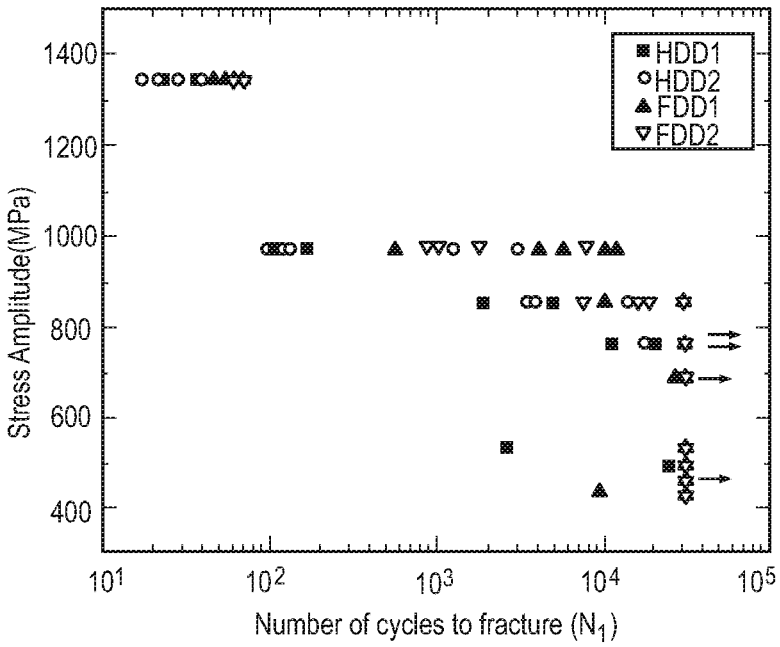
FIG. 3*b*: illustrates schematically and exemplarily an S-N curve comparison between FDD and HDD wires drawn to 75% CW.

The cyclic data collected from the Rotary Beam Fatigue Tester (RBFT) tests are plotted in an S-$N_f$ (Wohler) curve as illustrated in FIG. 3, where the S represents the stress amplitude, and $N_f$ represents the number of cycles to failure. It can be observed from FIG. 3(*a*), that the fatigue performance of the 50% CW FDD drawn wires was significantly higher than the HDD wires in both the low cycle fatigue (LCF) and high cycle fatigue (HCF) regimes. The runout (30 million cycles) achieved for a stress amplitude was indicated for the tested batch of wire, with the respective color-coded arrow. It can be noticed that in FDD drawn wires the runout stress amplitude in the HCF region was around 670-780 MPa, whereas the runout stress level for the HDD drawn wire was around 525-585 MPa. The LCF fatigue performance of the FDD drawn wires was also exceptionally higher than the HDD drawn wires with many specimens able to withstand over 1 million (1M) cycles, when tested between 1170-850 MPa stress amplitudes, however for the HDD drawn wires, the wire specimens could reach a fatigue endurance of 1M cycles only at a stress amplitude of 670 MPa.

With the increase of CW to 75% as illustrated in FIG. 3(*b*), the performance gap between the two drawn wires reduced, the FDD drawn wires could reach the runout at a stress amplitude 530-760 MPa, and the HDD drawn wires reached runout between 460 to 685 MPa. The LCF performance of the HDD drawn wires also improved when compared to the 50% CW conditions, there were multiple specimens which were capable of withstanding 1M cycles, in the stress range of 850 to 970 MPa. However, with the FDD drawn wires; nearly all the samples could reach 1M cycles, and a few of them could even reach the runout of 30M cycles at such high stress. Further increase of CW to 95%, improved the fatigue behavior of the HDD drawn wires both in the HCF and LCF regions when compared to the FDD drawn wires. The FDD wires reached the runout at a stress level of 1036 MPa whereas the HDD drawn wire could withstand the fatigue life of 30M cycles at a stress amplitude of 1110 MPa. The LCF performance of the HDD drawn wire was also observed to be significantly higher than the FDD drawn wire, with the HDD wires capable of withstanding the 1M cycles at a stress amplitude of 1200 MPa, with an average fatigue life of 16-23M. However, the FDD drawn wire had an average fatigue life of 2.7-9M only. The LCF performance of the HDD wire between the stress amplitude of 1400-1550 MPa was also on an identical note, with the HDD drawn wire outperforming the FDD drawn wire as illustrated in FIG. 3(*c*).

It is acknowledged that the prior deformation history or the method used to process the material to its finished size, influence the properties of the material. In the current study, by keeping the total area reduction or the total plastic strain constant, the amount of deformation reduction per pass has been differed to study the influence of the drawing method on the cyclic response of the MP35NLT™ wires. The fatigue performance of the FDD drawn wires were comparatively higher than the HDD drawn wires, in both the LCF and HCF regimes. The LCF and HCF behavior of the materials subjected to cyclic loading is dependent on the properties of the wire such as tensile strength, yield strength, and ductility, which are interrelated to the intrinsic microstructural parameters such as grain size, dislocation density, twin density, and the slip behavior. As seen in FIGS. 4*a-d*, the grain size (GS) of the FDD drawn wire was in the range of 100-500 nm, whereas the HDD wire OS was in the range of 700-1500 nm as in FIGS. 5*a-c*.

The smaller GS contributed to the increased strength of the material, where the FDD drawn wire had higher strength than the HDD wire. Since it is well acknowledged that in the HCF region, where the applied stress amplitudes are low, the fatigue behavior of the material is dominated by the crack initiation and most of the time is spent in initiating a crack, rather than propagating a crack which accounts for the total fatigue life. So, with smaller grain size, the residual stress distribution is more homogenous and spread over many grains in the FDD wire, which increased the fatigue resistance in the HCF region.

The LCF behavior of the FDD drawn wire was also better than the HDD wire, even though the GS is smaller for the FDD drawn wire, as the LCF performance is noticed to be enhanced with coarser grain size. At an applied stress amplitude of 1170 MPa, the average no of cycles to failure ($N_f$) for the three batches of FDD wire were, $3\times10^4$, $8\times10^5$ and $4\times10^6$ cycles; however, it was only $1\times10^4$ cycles for all the three batches of HDD wire tested. Even with the decrease of the stress amplitude to 853 MPa, which is considered as lower specification of the applied stress amplitude in the LCF region, the no of cycles to failure slightly improved for the HDD drawn wire with the $N_f$, being $4\times10^4$, $4.8\times10^4$ and $7\times10^4$, and $1\times10^5$, $7\times10^5$, and $1\times10^6$ for the FDD drawn wire.

Grain Size and Microstructure

Figure 5A:
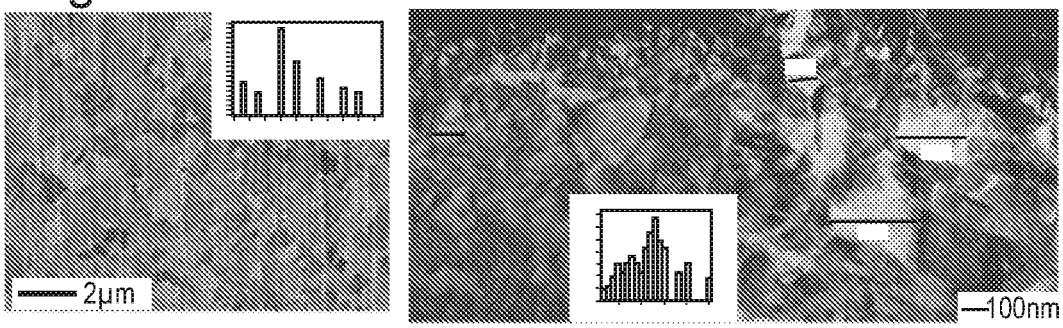
FIGS. 5*a-c*: illustrate schematically and exemplarily grain size distributions of the MP35NLT™ wire drawn with the HDD drawing process for different CW reductions.
Figure 5B:
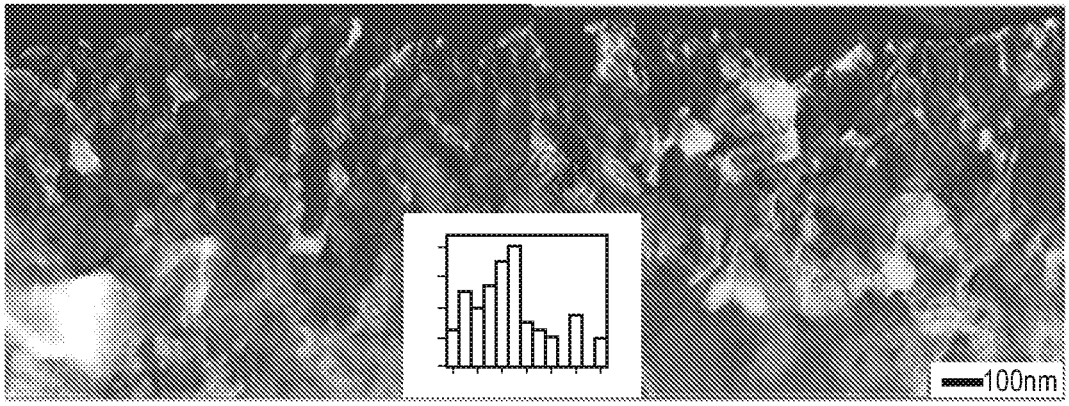
Figure 5C:
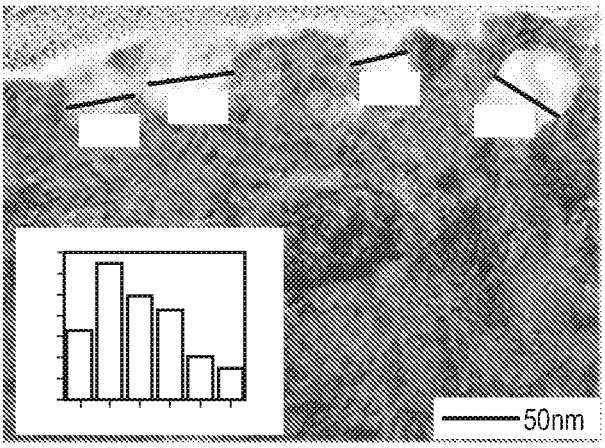
Figure 6A:
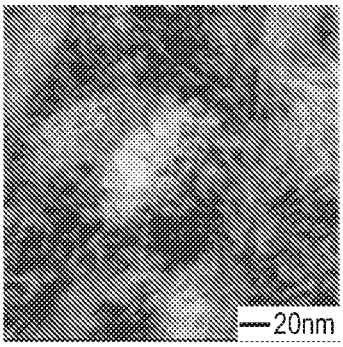
FIGS. 6*a-c*: illustrate schematically and exemplarily a dislocation density of the MP35NLT™ wire drawn with the FDD drawing process for different CW reductions.
Figure 6B:
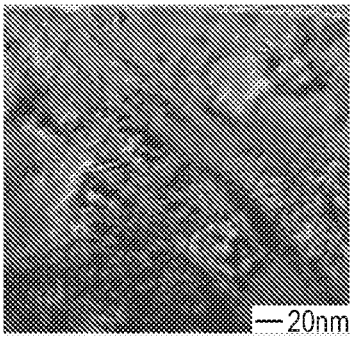
Figure 6C:
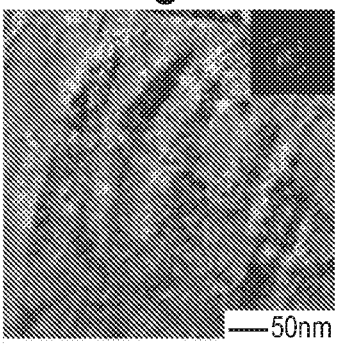
Figure 7A:
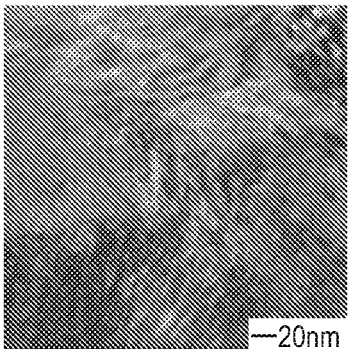
FIGS. 7*a-c*: illustrate schematically and exemplarily a dislocation density of the MP35NLT™ wire drawn with the HDD drawing process for different CW reductions.
Figure 7B:
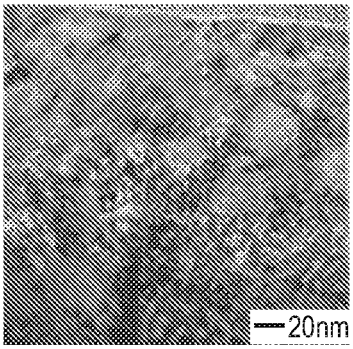
Figure 7C:
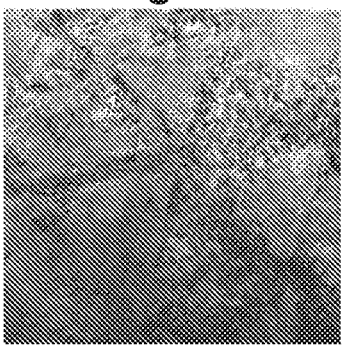
Figure 8A:
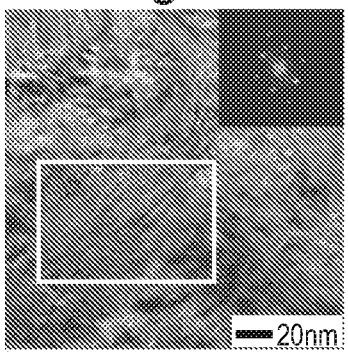
Figure 8B:
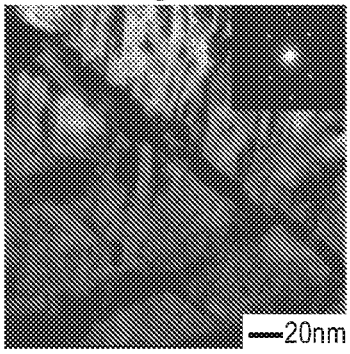
Figure 8C:
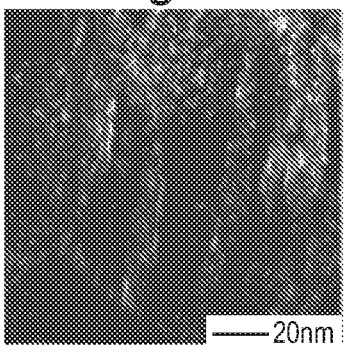

Faster reduction of the grain size to a nanometer size and severely deformed structure with high dislocation and twin density was obtained in MP35NLT™ and MP cladded wires drawn with FDD drawing practice, for a similar CW reduction. FIGS. 4*a-d* illustrate the TEM images of the grain size and microstructure of the FDD drawn wire drawn to different CW reductions and FIGS. 5*a-c* illustrates the grain size and the microstructure of the HDD drawn wire. The smaller grain size and the higher dislocation and twin density as illustrated in FIGS. 6*a-c* and FIGS. 7*a-c* contributed to higher strength and ductility in the material when compared to HDD wire as illustrated in FIGS. 8*a-c* and FIGS. 9*a-c*. The grain size linearly decreased with the increase of strain but the amount of decrease of the grain size was higher in the material drawn with FDD drawing process.

The dislocation and twin density were observed to be higher in the FDD drawn wire than the HDD drawn wire for a similar comparison of the applied strain and the dislocation and twin density increased with the increase of strain.

$Y_S$ (Yield Strength) and the UTS (Ultimate Tensile Strength)

The current disclosure describes the impact of the drawing technique on the mechanical properties of the wire like the $Y_S$ (Yield Strength) and the UTS (Ultimate Tensile Strength) whereby higher mechanical properties especially the yield strength of the wire was obtained in the FDD drawn wire when compared to the HDD drawn wire when subjected to a similar CW reduction. A higher work hardening rate and different hardening regimes are obtained with the MP35NLT™ material subjected to FDD drawing process.

Based on the above results it can be summarized that the work hardening rate in the FDD drawn samples are relatively higher when compared to the HDD wires. The initiation or onsite of twin formation is observed at a lower strain in FDD samples whereas the observation of twins is observed in HDD only at higher strains. So, it can be concluded that the FDD drawing process has a stronger effect in reducing the grain size and contributing to higher deformation twinning in the material, thus contributing to higher work hardening rates and increased strength in the wire.

Inhomogeneous Deformation

In metal forming processes, such as wire drawing, due to its high plastic deformation, there is a severe contribution of redundant work to the stress flow in the work piece, which makes the distribution of stress and strain to be non-uniform. This leads to a condition known as "Inhomogeneous Deformation" which brings about a heterogeneity in the texture and microstructure of the wires, thus affecting the mechanical and physical properties of the wire.

In the current work, the influence of the drawing practices on the inhomogeneous deformation was studied, by calculating the Inhomogeneous Factor (IF).

The current disclosure also describes the impact of the drawing technique on the hardness distribution and stress inhomogenity across the wire for wires subjected to different CW reduction. The hardness values ($H_V$) of the FDD and HDD drawn wires subjected to different CW reductions along Axis-1 (Transverse direction) and Axis-2 (Longitudinal). The hardness values measured across the wire cross section were used to determine the inhomogeneity in the wire, the equation for calculation the inhomogeneity is defined as, $$IF = \left(\frac{H_S - H_C}{H_C}\right)$$

where $H_S$ is the hardness at the surface of the wire and $H_C$ is the hardness at the center.

It was observed that the hardness value at the surface, was higher for the FDD wires when compared to the HDD wire until 50% CW, and the gradient in hardness ΔH (Hardness at the surface-Hardness at the center) was higher for the HDD drawn wires until 75% CW, after which it decreases until 95% CW. For the FDD samples, the hardness gradient for the 50% and 75% CW samples was comparatively lower than the HDD drawn wires. To understand the reason behind the variation in the ΔH gradient between the FDD and HDD samples, EBSD and FESEM analysis were performed on the samples deformed to various CW %. The ΔH gradient decreased with the increase of CW for both the FDD and HDD drawn wires, with the gradient being lower for the FDD wires and higher for the HDD wires. Microstructure and grain size analysis was repeated on the deformed samples to understand for the drop in ΔH gradient. With the increase of CW to 75% CW, microstructures of the wires drawn with different techniques appeared highly deformed, but the severity of deformation was higher for the FDD wire. With further increase of plastic deformation to 95% CW, the increase of ΔH gradient for the 95% FDD wire was marginally higher than the 75% CW wire, but lower than the 50% FDD wire, while the ΔH gradient decreased in the HDD wire. The IF value for the FDD drawn wire was lower than the HDD drawn wire, until 50% CW, after which the variation minimized. The IF values increased from the center of the wire to the surface, but the relative increase was higher in the HDD wires when compared to the FDD drawn wires. At 75% CW the curves were very similar to each other and the gradient between the surface and the center for both the drawn wires was minimal with the HDD drawn wire having a slightly higher IF value at the surface, however at 95% CW the IF value and the hardness gradient of the HDD drawn wires increased again when compared to FDD drawn wires. The reason for the variation in the hardness gradient in the wires drawn with different drawing practices are rationalized to the different microstructural and grain size distributions observed in the wires.

Based on the above findings, it can be concluded that the wires drawn with FDD drawing practice have a homogenous deformation throughout the wire cross section as noticed by the uniform hardness and microstructural gradient observed between the center and the surface of the wire. The FDD drawn wires have also higher strength and hardness when compared to the HDD processed wires. This explains as why a higher ΔH gradient was observed for the HDD samples, when compared to FDD wires. The significant difference in the grain size distribution along with the microstructural gradient observed between the surface and the center of the wire, would have contributed to the difference in the strength of the wire, with fine grains contributing to a higher strength and hardness, and coarser grains contributing to lower values. This corresponds well with the Hall-Petch relationship, on the increase of strength in the material with a decreased grain size. Smaller microstructural gradient was observed for the FDD wires between the center and the surface of the wires, thus contributing to a smaller ΔH gradient. The higher IF value imply an existence of higher redundant work in the work piece with increased level of non-homogenous deformation. However, for the FDD wires the deformation and stress distribution between the surface and the center of the wire surface was uniform which contributed to uniform microstructure and hardness gradient and lower IF values and thus homogenous deformation.

Electrical Properties

The current disclosure also studies the impact of the drawing method on the electrical properties of the wire. Electrical conductivity is an important property in the design of lead wires, and it is desirable for the wires build into leads to have a high electrical conductance or low electrical resistance in the order of 5-50Ω. The reciprocal of the electrical conductivity is termed as the electrical resistivity (ρ) and it measures the degree through which the conductor opposes the flow of current per unit length.

The electrical conductivity of the wire decreased with the increase of CW % and the conductivity of HDD drawn wires are higher than the FDD drawn wires until 70% CW, after which the gap between them lowered. This can be attributed to the variation in the deformation mechanics of the wire drawn with different drawing practices, which lead to different strengthening and different microstructures in the wire. The HDD drawn wires had a lower amount of lattice defects (dislocations and twins) in the microstructure when compared to the FDD drawn wires.

This explains why the HDD drawn wire had a higher electrical conductivity when compared to the FDD drawn wire. The results concluded that increased strength in the material by the generation of defects in the wire leads to a loss of electrical conductivity in the wire, due to the increased scattering of the conductive electrons, which results in a decreased electron mean free path and increased reflective coefficient.

Plastic Instability (PI)

Metals when plastically deformed by traditional forming methods such as rolling, forging, extrusion, wire drawing, significantly improved the strength of the material, however, the exceptional increase in strength has been compensated by the loss of ductility in many materials. This has been attributed to the flow localization in the material, which contributed to an expedited necking in the material during its tensile deformation in monotonic test conditions. This localized phenomenon of strain localization causes the deformation inhomogeneous driving to a phenomenon called plastic instability (PI). It is considered being a trade-off between the strain hardening (γ) and the strain rate sensitivity (m) of the material which resists or delays the necking in the material when subjected to a uniaxial tensile deformation. So, the control of plastic instability in the material is very important from an engineering standpoint of view, especially when the grain size is reduced to nanoscale for the desired strength improvements On the onset of the plastic instability, the material loses its load bearing capacity, and the stress continues to decrease with the increase of strain, leading to a catastrophic fracture.

The PI in the materials is defined by the equation;

$$\gamma+m\leq 1 \tag{1}$$

where $$\gamma=\left(\frac{\partial\sigma}{\partial\varepsilon}\right)_{\varepsilon} \text{ and } m=\frac{\partial(\ln\sigma)}{\partial(\ln\dot{\varepsilon})}|\varepsilon, T.$$

The PI of the FDD wire is lower when compared to the HDD wire at 50% CW reduction, with the (γ+m) value being 0.462 for FDD wire and 0.314 for HDD drawn wire. The higher (γ+m) in FDD wire can be ascribed to the higher strain hardening ability noticed in the FDD drawn wire when compared to the HDD wire where a γ value of 0.435 was obtained for the FDD drawn wire, whereas the HDD wire had a smaller γ value of 0.303. The results corresponded well to the higher strain rate sensitivity values (m) observed in the FDD drawn wire when compared to the HDD drawn wire (m=0.027 for FDD and m=0.011 for HDD). By increasing the total area reduction to 75%, the (γ+m) value for both the FDD and HDD drawn wire surged with the increase of deformation to 75% CW, with the gain being higher for the HDD wire (60%) than the FDD wire (11%) when compared to the results at 50% CW. The FDD drawn wire had a γ of 0.473 and m of 0.044, which led to (γ+m) value of 0.517, unlike the HDD drawn wire which had a (γ+m) value of 0.501, with γ and m values being 0.462 and 0.039 respectively. On further increase of CW reduction to 95% it can be observed that the (γ+m) value of the FDD drawn wire decreased significantly from a value of 0.517 at 75% CW to 0.295. However, for the HDD drawn wire, the decline in the (γ+m) value was lower from a value of 0.501 to 0.393.

Strain Rate (SR)

The effect of strain rate (SR) on the strain rate sensitivity (SRS), strain rate work hardening (SRWH) in Co-35Ni-20Cr-10Mo alloy (MP35NLT™) wires, subjected to drawing practices namely Full Die Drawing (FDD) and Half Die Drawing (HDD) is analyzed and reported. The deformation resistance or the fracture mechanics in the material subjected to plastic deformation are determined by its grain size, the applied strain rate and its processing temperature. As the strain rate determines the loading sensitivity of the material over time, the understanding of the plastic behavior of the metal when subjected to different strain rates is of great importance for ensuring the dependability and endurance of the material, during its service. The influence of the strain rate on the plastic deformation of the metals is determined by a parameter called Strain Rate Sensitivity (SRS) which is defined by $$m=\frac{d\ln\sigma}{d\ln\dot{\varepsilon}}|\varepsilon, T,$$

where σ is the applied stress and E is the applied strain rate for a given strain and temperature. The wires were subjected to a deformation strains of 0.64 (50% CW), and the samples collected for the particular strain are subjected to uniaxial tensile tests at room temperature, by varying the strain rate.

The stress of the wire increased with the increase of strain rate from $10^{-6}$ $s^{-1}$ to $10^{-2}$ $s^{-1}$ in both the FDD and HDD drawn wires, but the relative amount of increase in stress for an amount of strain is higher in the FDD drawn wire when compared to the HDD drawn wire. The FDD drawn wire had a strength of 2015 MPa, when subjected to a strain rate of $8.3\times10^{-6}$ $s^{-1}$ and increased to 2100 MPa when the strain rate was incremented to $3.3\times10^{-2}s^{-1}$, however in the HDD drawn wire, the strength of the wire was only 1870 MPa, at the lower strain rate and increased to 2020 MPa with the elevation in strain rate. There was a significant difference observed in the hardening behavior of the FDD and HDD drawn wire, for the applied strain rate. The FDD drawn wire exhibited a single stage hardening regime, at a lower strain rate of $8.3\times10^{-6}$ and displayed a three-stage hardening regime between the strain rates of $8.3\times10^{-5}s^{-1}$ to $3.3\times10^{-2}s^{-1}$, with the stage II peak increasing with the increase of strain rate. However, in the HDD drawn wire the material exhibited a single stage hardening curve up to a strain rate of $1.6\times10^{-3}s^{-1}$ and displayed an abnormal three stage hardening curve at a strain rate of $3.3\times10^{-2}s^{-1}$. It was also noticed that the normalized hardening values for the FDD drawn wire are comparatively higher than the HDD drawn wire for a similar strain rate applied. This was attributed to the increased dislocation density, reduced twin thickness, and a reduction in the Grain Boundary (GB) mechanisms such as GB sliding and shearing with the increased SR, due to decreased dislocation cell sizes and reduced pile up the GB. The Strain Rate Sensitivity (SRS), or m value of the FDD drawn wire decreased with the increase of SR, due to the reduction in the dislocation-based activities and increased GB shearing and diffusion in the deformed wire. The twin spacing increased with the increase of SR for the FDD drawn wire, thus contributing to a lower m. The m value linearly decreases with the increase of the strain rate for the FDD drawn wires, however for the HDD wire, the m value increases up to a strain rate of $10^{-5}$ $s^{-1}$ and then decreases with the increase of strain rate as in FDD samples. It could be seen that the FDD drawn wire had a higher m value when compared to the HDD drawn wire. The HDD drawn wire exhibited a different deformation mechanism with varying SR. At an SR of $10^{-6}$ $s^{-1}$, the strength and hardening of the material was significantly lower than the samples tested at other SR. TEM investigations, confirmed that in the low SR deformed sample, due to the absence of prior dislocations in the microstructure, the dislocation conciliated plastic deformation activities were absent in the material, which made the deformation intergranular due to the enhanced GB activities such as GB sliding. This limited the ability of the material to resist the large strains and thus promoting an extremely localized deformation, resulting in the formation of shear bands in the microstructure which made the deformation highly inhomogeneous and contributing to severe plastic instability in the material. This reduced the work hardening and load-bearing capacity of the material thus contributing to lower strength, ductility and a reduced SRS. An abnormal hardening effect was observed in the HDD drawn subjected to an SR of $10^{-2}$ $s^{-1}$, the stage II hardening peak originated at a very high strain, instead of its normal commencement at low SR, after the dynamic recovery. This effect was accredited to the solute segregation of the Mo atoms to the GB, as observed by the increased concentration of the Mo concentration in the deformed structure, which increased the strength and the hardening capacity of the wire.

The fracture morphology of the FDD samples looked different when compared to the HDD samples, with the low SR deformed FDD drawn wires exhibiting a higher fraction of the dimpled area and bigger dimple size and vice-versa. The dimpled region between the surface and the center of the wire looked homogeneous in size and shape. The fractography observations correlated well with the mechanical results of higher m and increased ductility seen in the FDD wire at a lower SR, which confirms the FDD drawn material to have higher resistant to necking, because of its higher SRS and higher hardening rate than the HDD wire.

However, with the HDD drawn wire, the fractography observation of the low SR samples exhibited smaller dimple size and a reduced fractured area, the fractured area also displayed a combination of shear and ductile mode fracture. The dimple size at the surface of the wire was smaller when compared to the center, and the deformation looked inhomogeneous.

Stress Relief

The disclosure also explains that MP35NLT™ and MP35NLT™/Ag wires drawn with different filling ratios in the range of 15-41%, when subjected to a prior CW of 95-96% and drawn to a final diameter and subjected to a final stress relief operation in the range of 800-900° C. with a dwell time of 2-3 seconds led to a reduction in the EL % and an improvement in the YS and the UTS of the wire, but the reduction of EL was gradual with time and the properties of the wire needed two weeks for stabilization, with higher stress relief temperature contributing to a higher drop when compared to a lower temperatures as illustrated in Table 3, and also contributing to a higher YS/UTS ratio of >0.9.

The wires drawn with the FDD drawing process produced a microstructure with coarse grains at the surface of the wire and fine grains at the center as illustrated in FIG. 10 with a randomly oriented microstructure.

TABLE 2

Mechanical data of the lots drawn with the FDD drawing process and subjected to stress relief.

| | | | | | | | | Properties of the wire prior to stress relief | | | Properties of the wire after stress relief with aging duration | | | | |
|---|---|---|---|---|---|---|---|---|---|---|---|---|---|---|---|
| Condition | Material | Prior CW % | Final anneal temp | Dwell time (Seconds) | Final CW % | Stress relief temp | Stress relief time | YS (MPa) | UTS (MPa) | EL % | Aging time (days) | YS (MPa) | UTS (MPa) | EL % | YS/UTS |
| A | MP Ag 25% | 95-96 | 900 | 7.80 | 45-60 | 875 | 3.1 | 1309 | 1516 | 2.58 | 0 | 1382 | 1476 | 2.24 | 0.94 |
| | | | | | | | | | | | 7 | 1433 | 1509 | 2.20 | 0.95 |
| | | | | | | | | | | | 14 | 1442 | 1506 | 2.03 | 0.96 |
| | | | | | | | | | | | 21 | 1455 | 1509 | 1.87 | 0.96 |
| | | | | | | | | | | | 25 | 1459 | 1507 | 1.77 | 0.97 |
| | | | | | | | | | | | 48 | 1466 | 1510 | 1.65 | 0.97 |
| B | MP Ag 25% | 95-96 | 950 | 7.80 | 45-60 | 875 | 3.1 | 1320 | 1537 | 2.51 | 0 | 1455 | 1547 | 2.13 | 0.94 |
| | | | | | | | | | | | 7 | 1456 | 1547 | 2.16 | 0.94 |
| | | | | | | | | | | | 14 | 1460 | 1541 | 2.06 | 0.95 |
| | | | | | | | | | | | 21 | 1474 | 1547 | 1.90 | 0.95 |
| | | | | | | | | | | | 25 | 1475 | 1542 | 1.81 | 0.96 |
| | | | | | | | | | | | 48 | 1479 | 1545 | 1.76 | 0.96 |
| C | MP Ag 25% | 95-96 | 875 | 7.80 | 45-60 | 875 | 3.1 | 1301 | 1519 | 2.73 | 0 | 1385 | 1478 | 2.33 | 0.94 |
| | | | | | | | | | | | 7 | 1415 | 1479 | 1.87 | 0.96 |
| | | | | | | | | | | | 14 | 1437 | 1490 | 1.75 | 0.96 |
| | | | | | | | | | | | 21 | 1451 | 1489 | 1.67 | 0.97 |
| | | | | | | | | | | | 25 | 1459 | 1495 | 1.65 | 0.98 |
| | | | | | | | | | | | 48 | 1462 | 1497 | 1.63 | 0.98 |
| D | MP Ag 25% | 95-96 | 900 | 7.80 | 45-60 | 900 | 2.2 | 1338 | 1561 | 2.40 | 0 | 1444 | 1538 | 1.89 | 0.94 |
| | | | | | | | | | | | 7 | 1464 | 1548 | 1.73 | 0.95 |
| | | | | | | | | | | | 14 | 1482 | 1551 | 1.67 | 0.96 |
| | | | | | | | | | | | 21 | 1489 | 1552 | 1.63 | 0.96 |
| | | | | | | | | | | | 25 | 1490 | 1554 | 1.62 | 0.96 |
| | | | | | | | | | | | 48 | 1496 | 1557 | 1.60 | 0.96 |
| E | MP Ag 25% | | 875 | 7.80 | 45-60 | 900 | 3.1 | 1385 | 1579 | 2.38 | 0 | 1396 | 1484 | 1.76 | 0.94 |
| | | | | | | | | | | | 7 | 1403 | 1494 | 1.72 | 0.94 |
| | | | | | | | | | | | 14 | 1412 | 1494 | 1.66 | 0.95 |
| | | | | | | | | | | | 21 | 1419 | 1498 | 1.62 | 0.95 |
| | | | | | | | | | | | 25 | 1426 | 1500 | 1.60 | 0.95 |
| | | | | | | | | | | | 48 | 1430 | 1505 | 1.58 | 0.95 |

TABLE 2-continued

Mechanical data of the lots drawn with the FDD drawing process and subjected to stress relief.

| Condition | Material | Prior CW % | Final anneal temp | Dwell time (Seconds) | Final CW % | Stress relief temp | Stress relief time | Properties of the wire prior to stress relief YS (MPa) | UTS (MPa) | EL % | Aging time (days) | Properties of the wire after stress relief with aging duration YS (MPa) | UTS (MPa) | EL % | YS/UTS |
|---|---|---|---|---|---|---|---|---|---|---|---|---|---|---|---|
| F | MP Ag 25% | 95-96 | 900 | 7.80 | 45-60 | 855 | 2.5 | 1260 | 1488 | 2.35 | 0 | 1343 | 1446 | 2.16 | 0.93 |
| | | | | | | | | | | | 7 | 1397 | 1486 | 2.08 | 0.94 |
| | | | | | | | | | | | 14 | 1407 | 1483 | 1.96 | 0.95 |
| | | | | | | | | | | | 21 | 1409 | 1479 | 1.83 | 0.95 |
| G | MP Ag 25% | 85-90 | 900 | 7.8 | 70-85 | 900 | 2.5 | 1456 | 1658 | 2.35 | 0 | 1282 | 1437 | 2.18 | 0.89 |
| | | | | | | | | | | | 7 | 1325 | 1470 | 1.89 | 0.90 |
| | | | | | | | | | | | 14 | 1345 | 1494 | 1.75 | 0.90 |

The wires manufactured by the above process also led to a wire free from the inherent residual cast and lift present in the wire this leading to a straight wire on the spool without any mechanical damages induced by the roller straightening processes. These types of wires can be used for wires needed for IV therapy and guiding systems for medical applications with an added advantage of high strength and kink resistance.

It has to be noted that embodiments of the disclosure are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the disclosure has been illustrated and described in detail in the drawings and foregoing description, such illustration and description are to be considered illustrative or exemplary and not restrictive. The disclosure is not limited to the disclosed embodiments. Other variations to the disclosed embodiments can be understood and effected by those skilled in the art in practicing a claimed disclosure, from a study of the drawings, the disclosure, and the dependent claims.

In the claims, the word "comprising" does not exclude other elements or steps, and the indefinite article "a" or "an" does not exclude a plurality. A single unit may fulfil the functions of several items re-cited in the claims. The mere fact that certain measures are re-cited in mutually different dependent claims does not indicate that a combination of these measures cannot be used to advantage.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A method for manufacturing a biocompatible wire, comprising:

providing a workpiece of a biocompatible metallic material;

cold working the workpiece into a wire; and annealing the wire;

wherein a cold work percentage is 97 to 99%;

wherein the cold working is a drawing with a die reduction per pass ratio in a range of 6 to 40%;

wherein the drawing is done with a Δ value deformation factor in a range of 1.2 to 2.0 and a contact length between the workpiece and a drawing tool in a range of 0.5 to 0.2 mm; and wherein the annealing is done in a range of 850 to 1100° C.

2. The method according to claim 1, wherein the drawing is a full die drawing.

3. The method according to claim 1, wherein the drawing is done with a speed in a range of 15 to 150 m/min.

4. The method according to claim 1, wherein an initial diameter of the workpiece before drawing is in a range of 3 to 5 mm and/or a diameter of the wire after drawing is in a range of 0.1 to 0.9 mm.

5. The method according to claim 1, wherein the annealing is done for 750 to 1500 seconds.

6. The method according to claim 1, further comprising an additional drawing after the annealing with a cold working percentage of 95 to 97%.

* * * * *